US005909848A

United States Patent [19]

Zink

[11] Patent Number: 5,909,848

[45] Date of Patent: Jun. 8, 1999

[54] HIGH PRESSURE LIQUID ROTARY NOZZLE WITH COIL SPRING RETARDER

[75] Inventor: Gerald P. Zink, Durango, Colo.

[73] Assignee: Stoneage, Inc., Durango, Colo.

[21] Appl. No.: 09/118,489

[22] Filed: Jul. 17, 1998

[51] Int. Cl.[6] ..... B05B 3/06

[52] U.S. Cl. ..... 239/252; 188/82.1; 188/82.5; 188/184; 188/185

[58] Field of Search ..... 239/251, 252; 188/82.1, 82.5, 184

[56] References Cited

U.S. PATENT DOCUMENTS

| | | | |
|---|---|---|---|
| 4,660,766 | 4/1987 | Nelson et al. | 239/222.17 |
| 4,704,826 | 10/1987 | Kirkland | 239/252 |
| 4,932,590 | 6/1990 | Hunter | 239/252 |
| 5,503,334 | 4/1996 | Patch | 239/251 |

*Primary Examiner*—Andres Kashnikow
*Assistant Examiner*—Dinh Q Nguyen
*Attorney, Agent, or Firm*—Maxwell C. Freudenberg; Kenton L. Freudenberg

[57] ABSTRACT

A high pressure liquid nozzle housing encloses a self-rotating speed-controlled nozzle. A cylindrical sleeve in the housing forms an inwardly facing friction surface engageable by a nozzle-driven friction generating speed control mechanism to provide increasing retarding force on the nozzle as nozzle speed increases for controlling maximum nozzle rotational speed. The speed control mechanism includes a radially expandable helical coil spring rotatable with the nozzle with its windings at low nozzle speeds slightly spaced from the sleeve. An input end of the coil spring is driven by the nozzle structure in a direction tending to unwind the spring and increase its outer diameter in response to rotation of the nozzle. An output end of the coil spring rotatably drives a cluster of centrifugal weights which are spring biased away from the sleeve and which at low nozzle rotation speeds also remain spaced from the sleeve. At higher speeds of nozzle rotation the weights move outwardly and frictionally engage the sleeve and provide a drag on the output end of the spring to aid in unwinding the spring, increasing its diameter and moving it with progressively increasing force into friction creating engagement with the sleeve to provide progressively increased retarding force against nozzle rotation as nozzle speed increases. The weights and spring retarding forces combine, but the spring retarding force is several times the retarding at the weights when an equilibrium between retarding forces and opposing jet stream nozzle reaction is reached at maximum nozzle speed.

29 Claims, 7 Drawing Sheets

HIGH PRESSURE LIQUID ROTARY NOZZLE WITH COIL SPRING RETARDER

This invention relates to a small rotary nozzle assembly for spraying high pressure liquids and having a centrifugally controlled radially expandable helical coil spring device driven by a rotary nozzle to act as a rotary speed retarder to prevent undesirable overspeed of nozzle rotation.

BACKGROUND OF THE INVENTION

In the field of high pressure rotary liquid handling devices where the operating parameters can exceed 10,000 psi, rotating speeds of 1,500 rpm and flow rates of 25 gpm, operating parameters relating to construction, cost, durability and ease of maintenance of rotating small nozzles present many problems. Combined length and diameter of such nozzles may not exceed a few inches. The more extreme operating parameters and great reduction in size compound the problems. Pressure, temperature and wear factors affect durability, ease of maintenance and attendant cost, and inconvenience and safety in use of such nozzle devices. Simple durable low cost and easily maintained speed controlled nozzles are most desirable.

SUMMARY OF THE INVENTION

Among the objects of the invention is to simplify the configuration of wearing parts of a small high pressure spray nozzle to reduce the number and cost and facilitate economical manufacture and replacement of the wearable parts.

Another object of the invention is to help achieve a small durable light weight elongated and small diameter rotating high pressure spray nozzle assembly which can be conveniently carried on the end of a spray lance and readily inserted into small diameter tubes and the like to clean the same as well as being usable on other structures or large flat areas.

Another object of the invention is to provide a nozzle with a speed retarding mechanism having a first relatively low friction generation mechanism reacting to nozzle speed control which directly interacts with a higher friction generating mechanism also under nozzle speed control to achieve a desired retarding of nozzle speed.

Another object of the invention is to provide a durable rotation speed control mechanism for the rotating spray head in an elongated small diameter high pressure water spray assembly.

Another object of the invention is to provide an improved speed control mechanism for a rotating nozzle member of a small diameter high pressure spray nozzle assembly using a centrifugally responsive actuator.

Another object of the invention is to provide an improved speed control mechanism for a rotating nozzle member of a small diameter high pressure spray nozzle assembly using a mechanism incorporating a centrifugal weight controlled radially expandable helical coil spring for nozzle speed retardation control.

Another object of the invention is to provide an improved speed control mechanism for a rotating nozzle member of a small diameter high pressure spray nozzle assembly using unwinding radial expansion of a radially expandable helical coil spring against an internal small diameter cylindrical wear resistant surface to create a nozzle retarding effect.

Another object of the invention is to provide in a single isolated sealed chamber of a small diameter high pressure spray nozzle assembly an improved speed control mechanism for a rotating nozzle member and a rotating nozzle bearing assembly.

Another object of the invention is to limit temperature rise in heat generating components of elongated small diameter high pressure water spray nozzle assemblies.

A further object of the invention is to provide an improved rotatable nozzle assembly wherein removal of all principal parts of rotary nozzle support bearings and rotary nozzle speed control mechanisms from a common sealed chamber therefor is achieved through one end of a housing body containing a rotatable nozzle.

Another object of the invention is to provide improved means for replenishing or replacing lubricating liquid of stable viscosity into a sealed chamber enclosing a speed control mechanism by merely temporarily removing a plug for a fill opening into the chamber and pumping new liquid into the chamber.

Another object of the invention is to achieve a significant amount of retarding force on a rotary nozzle of a spray nozzle assembly by viscous shear in a speed control mechanism having friction generating speed retarding parts immersed in the liquid.

The high pressure nozzle of this invention is intended for use in a High Pressure (HP) range of approximately 5,000 to 30,000 psi. Thus the seal between a relatively stationary seal holder and the rotating inlet end of a rotary nozzle tube must contain any selected pressure to be used. For a selected pressure, the flow rate and the orientation of the nozzle discharge tips provide the reactive force to rotate the nozzle. With a nozzle speed control means utilizing interrelated friction generating speed retarding mechanisms immersed in a high temperature resistant lubricating liquid, such as automatic transmission fluid, confined in a sealed protected speed control chamber to prevent overspeeding, the speed can be selectively kept in the range of about 100 to 2000 rpm for a spraying operation. Without practical maximum speed control a runaway nozzle can reach several thousand rpm which can detrimentally affect the spraying function and also rapidly increase wear of seals, bearings and other operating parts of the rotary nozzle structure.

Radial ball bearings form axially spaced load distributing bearing means between a rotating nozzle shaft and an inner cylindrical surface of a nozzle housing body. The bearings rotatably support the shaft coaxially within the housing body, and prevent axial movement of the shaft when the shaft is subject to high forwardly directed thrust forces from internal high liquid pressures at rotary seal members in the nozzle assembly, The nozzle structure comprises a generally cylindrical housing body forming a relatively stationary reference structure with respect to a coaxial rotatable nozzle carrying tubular shaft member contained therein. The shaft member is a rotary structure having an input end in sealed relationship with a connecting high pressure liquid input member in the input end of the housing which has an internally threaded portion for receiving the male threaded end, i.e. cone- and thread or conventional pipe threads, of a nozzle structure supporting lance or other means (not shown) for supplying the high pressure spray liquid to the nozzle structure.

Between the liquid input member and the input end of the nozzle shaft is a high pressure sealing assembly forming a passage for confining high pressure liquid being transferred to the nozzle and comprising a stationary annular seal holder opposite to the end of the shaft for supporting annular seal components arranged end-to-end and having inner diameters corresponding to the inner diameter of the input end of the shaft. The seal holder is counterbored to provide a stepped annular recess with a smooth cylindrical wall coaxial with the shaft and containing the end-to-end components comprising a plastic annular cylindrical seal member and an annular cylindrical carbide wear resistant hard sealing ring seat which is held between the plastic seal and the end of the shaft when high pressure liquid flows through the nozzle during its spraying operation. The carbide seat is kept coaxial with the shaft by the stepped recess and its forward end projects beyond the recess into sealing engagement with the end of the shaft. The outside wall of the plastic seal fits snugly against the wall of the stepped recess and has an additional softer sealing O-ring seal in a longitudinally-central annular groove between the plastic seal and the wall of the stepped recess to provide additional sealing means therebetween and hold the plastic seal in position against rotation and against the carbide seat as the latter is held against the shaft by pressure of the spray liquid on the plastic seal and rotates with the shaft during operation of the nozzle. As the end of the plastic seal wears where it contacts the carbide seat, liquid pressure on the plastic seal will push it forwardly along the stepped recess to assure continuity of the sealing assembly at the input end of the shaft.

The seal contains the high working pressure of the high pressure spray liquid and prevents escape of high pressure liquid from the intended liquid flow path passage into the inlet end of the tubular nozzle member. The seal member is made of an extrusion-resistant cross-linked ultra-high molecular weight polyethylene. The additional softer sealing O-ring is preferably of resilient tough heat-resistant elastomeric material held in a groove of rectangular cross section machined in the outer cylindrical surface of the seal member midway along its length. When the end of the seal member engaging the inlet end of the seat wears down to near the O-ring groove, the plastic seal member can be removed and reversed and used until the other end of the seal member becomes similarly worn.

The seal assembly used permits easy replacement of a single plastic seal member with O-ring when it is worn at a small fraction of the cost of replacement of the carbide seat. The carbide seat is pressed axially against and rotates with the nozzle shaft during operation of the spray nozzle apparatus.

The sealing assembly comprises the seal holder, the plastic seal and the carbide seat. This provides a very effective seal at low cost because of the simplicity of configuration of these three principal parts and their manner of retention, and replacement when necessary after wear, during the life of the nozzle structure. Wear of 50% of the plastic seal is tolerated without degradation of sealing by this assembly.

A rotational speed control means for the spray nozzle is contained in a sealed chamber which encloses ball bearing means for rotatably supporting the rotatable tubular nozzle shaft member which carries the spray liquid to the nozzle spray head. This chamber is sealed to protect the bearing and speed control mechanisms and lubricants therefor from any spray liquid which might escape from the spray liquid passages within the nozzle housing.

The speed control is useful in governing the spray pattern from the spray head as the nozzle assembly is moved by its support relative to an object or surface being sprayed. Also the reduced rotational speed significantly reduces wear and heat generation at the moving parts within the nozzle assembly.

The sealed bearing-enclosing and speed control chamber is closed at the forward end of the housing by a removable cup-shaped clamping member and an annular forward end lip seal between the outer surface of the shaft and an inner surface of the clamping member. The rear end of the sealed chamber is sealed by an annular lip seal between the shaft and a necked portion of the housing. A removable threaded plug in an opening in the clamping member allows lubricating liquid to be injected under pressure into the sealed chamber. The lips of the seals are so arranged that the forward seal blocks escape of the liquid but the rear seal allows liquid to escape past its lip and thus allow replenishment or complete replacement of the liquid by merely removing the plug.

The various internal elements in the sealed bearing chamber of the nozzle assembly, including the bearings, are kept in relatively fixed axial positions by means including the removable clamping member which pushes all such elements toward one end of the housing where an element of the assembly abuts an inwardly extending housing shoulder.

DESCRIPTION OF THE PREFERRED EMBODIMENT

FIGS. 1–4 show a high pressure liquid nozzle apparatus assembly having an elongated cylindrical nozzle housing body 10 within which is rotatably mounted a coaxial two-piece hollow or tubular nozzle shaft structure having a first tubular shaft member 11 with a female threaded forward end into which is screwed the male rear end of a coaxial shaft extension 13 having a Y-shaped passage feeding two nozzle sockets in a nozzle head 14. The hollow shaft structure

11–13 carries high pressure liquid to a discharge spray head 14 at one end of the body 10. Nozzle means on the forward end of the rotating nozzle shaft provides multiple jet streams of the liquid for cleaning purposes with the streams oriented to provide a jet reaction torque on the nozzle shaft to make it self-rotating. For shaft retarding purposes pointed out hereinafter the direction of self rotation in this illustrated embodiment is clockwise when looking into the discharge end of the nozzle assembly. This also keeps the extension 13 screwed securely into the shaft member 11.

Figure 1:
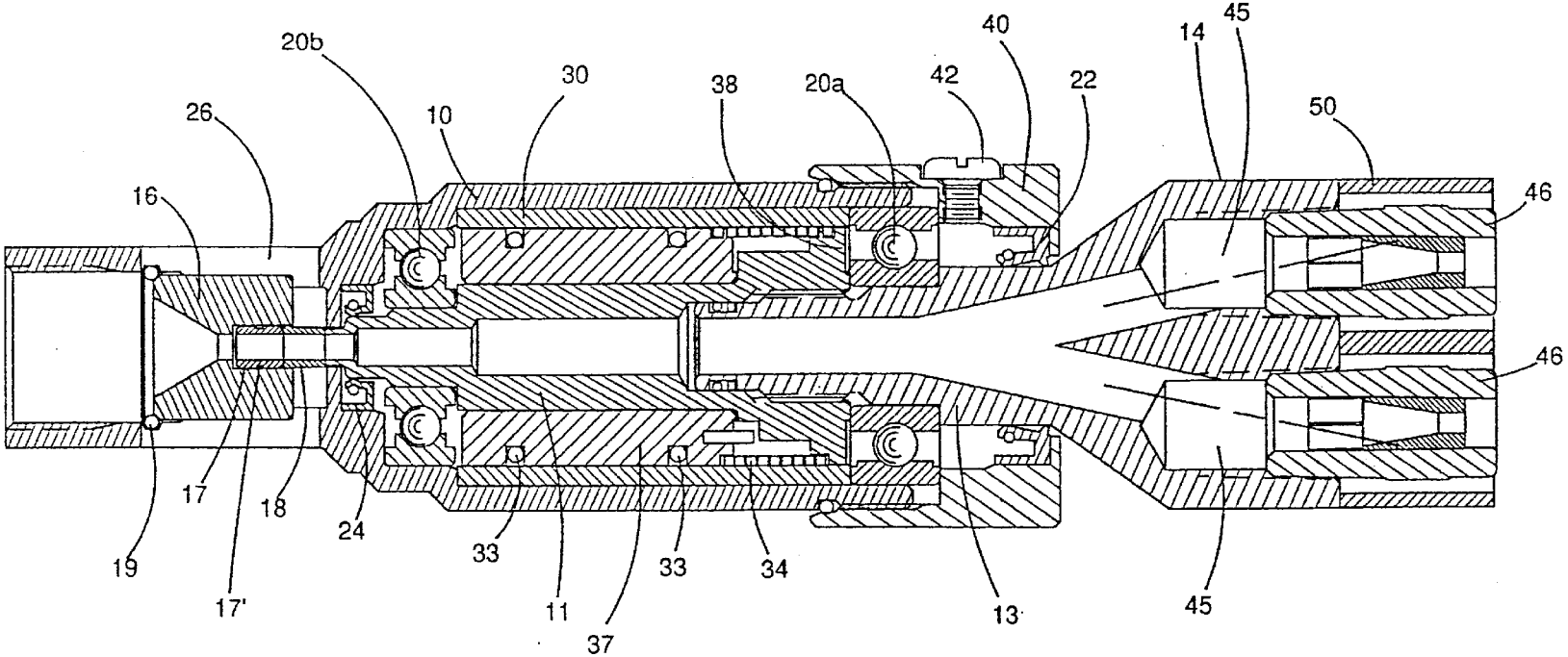
FIG. 1 is a longitudinal section of a high pressure liquid spray nozzle apparatus using for nozzle rotor speed control a centrifugal weight controlled radially expandable unwindable coil spring engageable with a cylindrical friction surface to prevent overspeeding and showing a forward end cap for keeping internal components of the spray apparatus clamped in place.
Figures 2, 3:
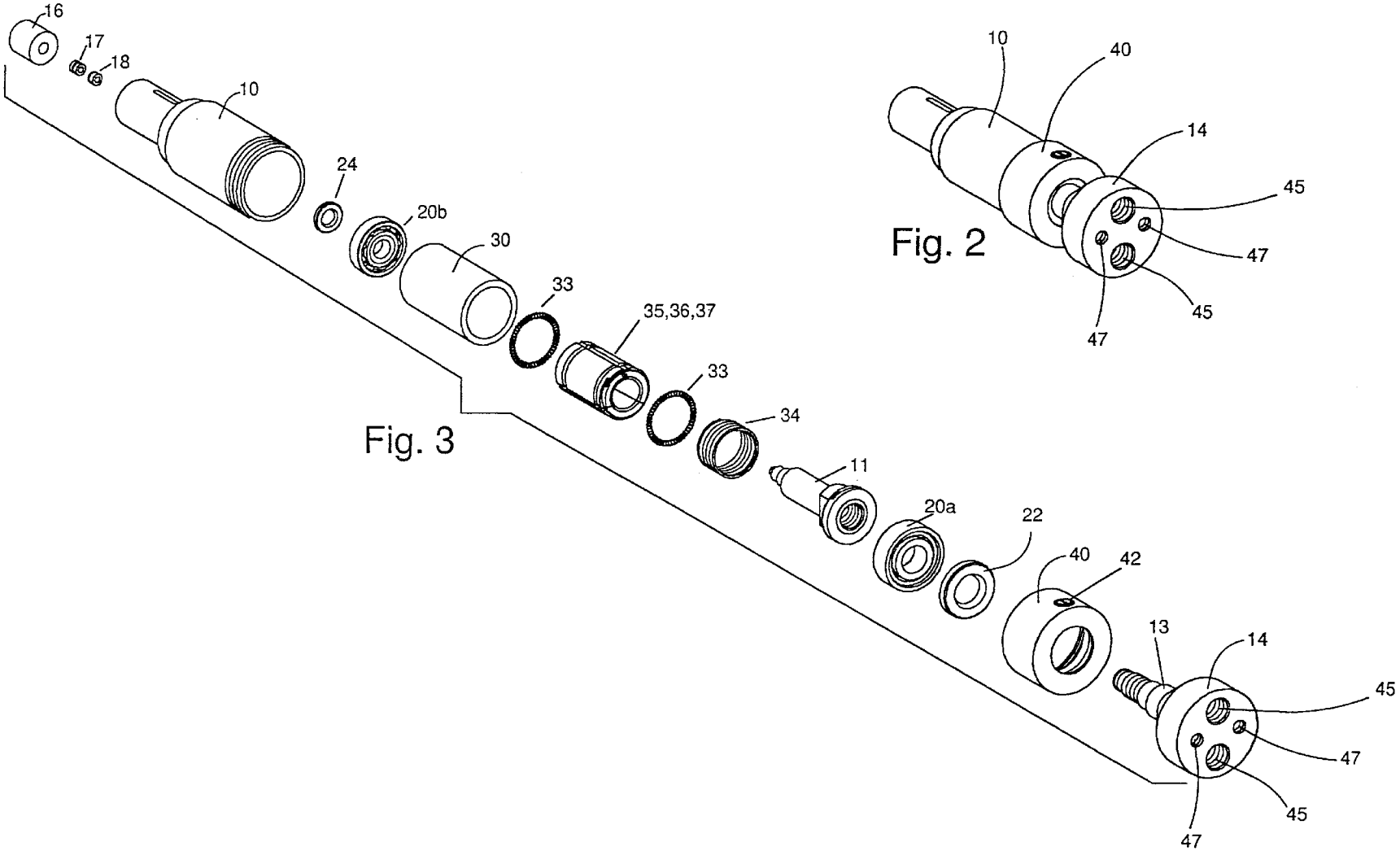
FIG. 2 is a perspective view of the nozzle apparatus of FIG. 1 from its outlet end, but with nozzle discharge tips and a protector for the tips omitted.
FIG. 3 is an perspective exploded view of the nozzle apparatus of FIG. 2.
Figure 4:
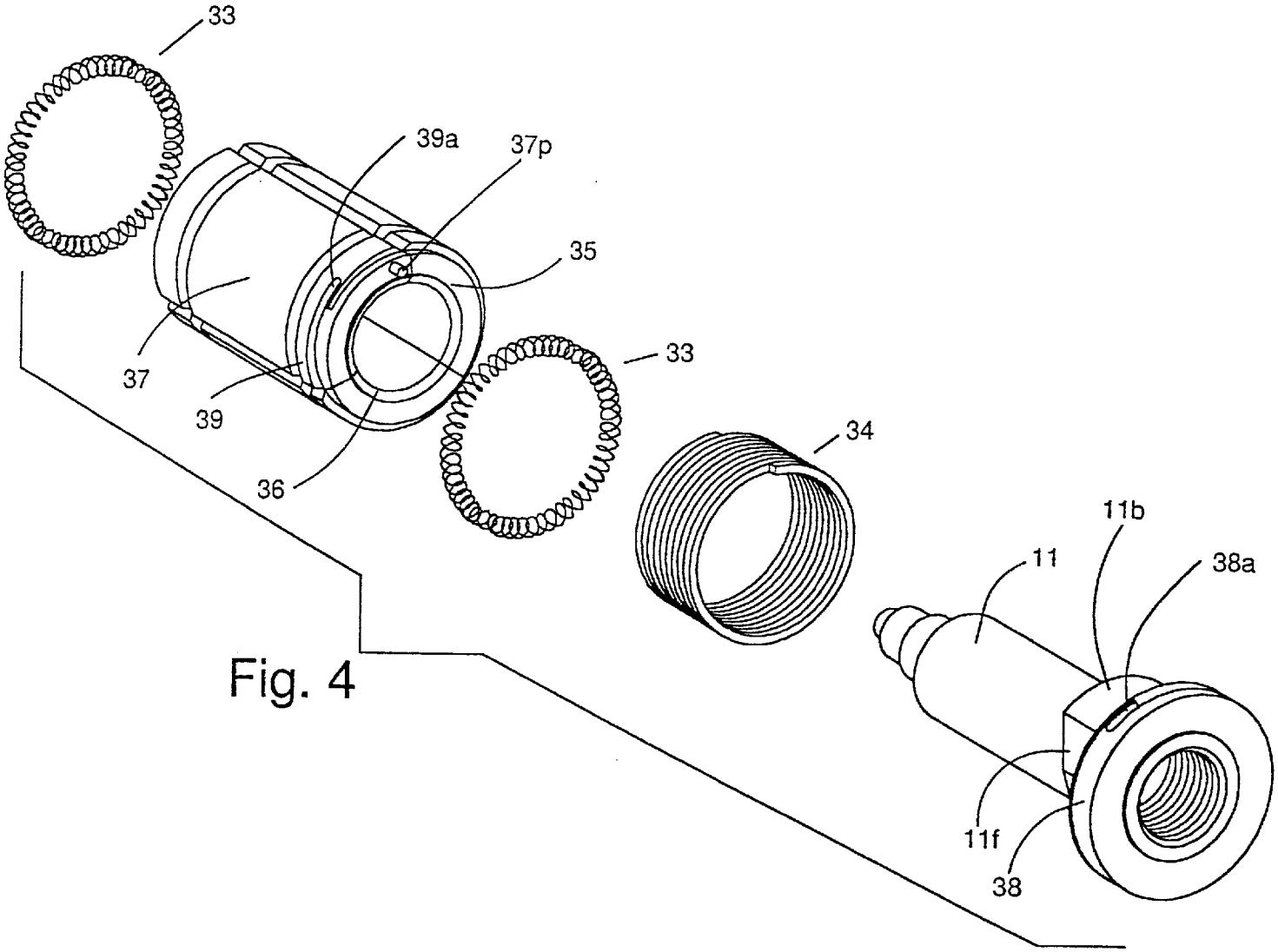
FIG. 4 is an enlarged exploded view of the principal coil spring speed control components used in the nozzle of FIGS. 1–3.
Figure 5:
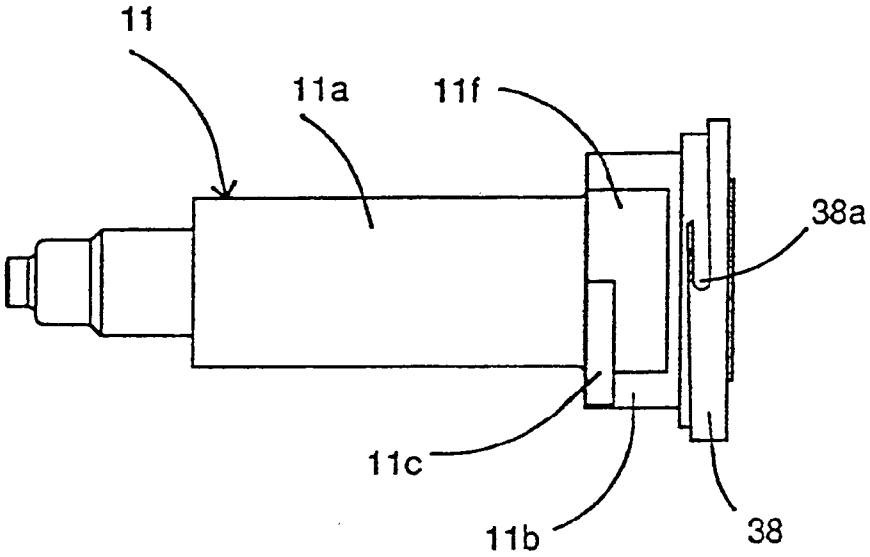
FIG. 5 is a side view of a shaft member forming part of the subassembly of FIG. 4.
Figure 5A:
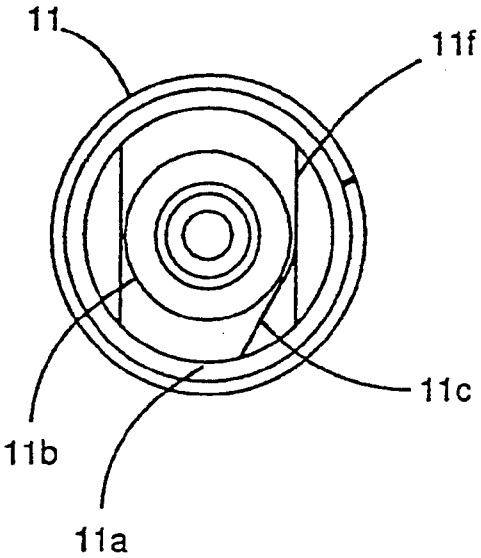
FIG. 5A is a rear end view of the shaft member of FIG. 5.
Figure 6:
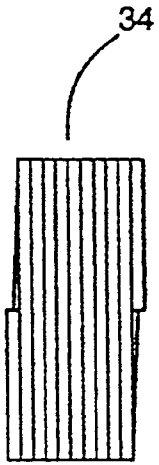
FIG. 6 is a side view of a helical coil spring forming part of the subassembly of FIG. 4.

As seen in FIG. 1, the arms of the Y-shaped passage in the rotatable shaft structure 11–13 connect with threaded cylindrical canted bores 45 in head 14 of the nozzle structures. Nozzle discharge tips 46 are threaded into these canted bores 45. The end of the upper nozzle tip 46 in FIG. 1 is canted toward the reader and the end of the lower nozzle tip 46 in FIG. 1 is similarly canted away from the reader so that reaction forces due to jet streams from these nozzle tips 46 rotate the nozzle head 14 clockwise as seen looking toward the nozzle discharge end, or in the direction of a right hand screw to keep the shaft extension member 13 screwed into the shaft member 11.

High pressure liquid is supplied to the inlet end of the shaft 11 by inlet means comprising a necked down inlet end of the housing body 10 which is internally threaded to connect to a conventional cone-and-thread threaded connector on the end of a hose or a lance forming the source of high pressure liquid (not shown) for the nozzle assembly. The inside of the inlet end of the body 10 has a smooth cylindrical bore which ends at an inwardly directed shoulder providing an annular sealing surface against which a seal holder 16 is clamped by the cone-and-thread connector of the liquid supply source. The seal holder has a cylindrical outer surface which is slidable within the bore in the inlet end of body 10. The holder 16 has a conical high pressure liquid entrance forwardly tapering to a short reduced diameter cylindrical orifice. Just forward of the orifice is a stepped smooth annular cylindrical counterbored seal supporting surface completely enclosing an axially slidable annular plastic seal 17 which abuts a hard durable carbide annular seal member or seat 18 which is partially contained in the seal holder 16 counterbore.

When the conventional cone-and-thread connector on the high pressure liquid source (not shown) is secured in the entrance end of housing body 10 it forms a sealed connection at the conical entrance to the seal holder 16 and clamps the seal holder 16 tightly in place against the shoulder at the end of the bore in the inlet end of housing body 10. The stepped coaxial counterbored passage of the seal holder 16 presents a smooth inner cylindrical surface within which are coaxially supported in end-to-end relationship the annular cylindrical deformable seal member 17 and the annular cylindrical rigid carbide seat 18 which are pushed forward solely by high liquid pressure on the seal member 17 and on the seat 18 to force the seat against the inlet end of the shaft 11. The sealing seat member 18 has a first end face beveled at its outer edge and abutting the shaft 11 with an area of contact smaller than an area where its opposite end face abuts the seal member 17 whereby the force differential across the seat 18 due to the high pressure liquid in said inlet passage holds the seat 18 against the shaft during operation of the apparatus.

The seal member 17 has an elastomeric O-ring in a longitudinally central annular groove of rectangular cross section in its outer surface to prevent high pressure liquid from flowing between the outer cylindrical surface of the seal 17 and the wall of the counterbore in seal holder 16. The seal member 17 is made of hard strong wear resistant deformable extrusion-resistant material such as a cross linked ultra-high molecular weight polyethylene.

Upon removal of the cone-and-thread connection on the high pressure liquid source from the inlet end of the housing body 10, the sealing assembly comprising seal holder 16, the seal 17 and the seat 18 is free to be withdrawn from the inlet end of the housing body 10 for inspection, repair or replacement, without interfering with or disassembling any other part of the nozzle apparatus. To prevent inadvertent separation of the seal holder 16, seal 17 and the seat 18 from the inlet end of the housing body 10, a retaining O-ring 19 is removably held at the outer end of the seal holder 16 in a groove in the inner wall of the end of the body 10.

The seal components comprising the seal holder 16, the deformable seal member 17 and the carbide seat 18 form a high pressure liquid sealing means within said housing body 10 for confining high pressure liquid flow between the inlet end connection to the housing body 10 and the inlet end of the shaft member 11 to a flow passage within said housing body which is isolated from the interior of a sealed chamber between the shaft structure 11–13 and the housing body 10. Any leakage of high pressure liquid to the outside of the seal 17 and seat 18 can escape through the slotted weep passages 26 in the body 10 to the outside of the nozzle assembly. The inlet end of the shaft 11 has a reduced diameter portion extending rearwardly through a small aperture in a transverse wall in the body 10 and into the chamber bled by the weep holes 26 where the seat 18 seals against the inlet end of the shaft 11.

The illustrated seal holder 16, seal member 17 and seal seat 17 are disclosed in copending application Ser. No. 09/071,384, filed Apr. 30, 1998, in which applicant is a joint inventor and which is incorporated herein by reference.

The sealed chamber contains radial ball bearings **20*a* and 20*b* for rotatably supporting the shaft structure 11–13, a shaft speed control mechanism described in detail hereinafter and lubricating means. Ends of the sealed chamber are defined just beyond the bearings 20*a* and 20*b* by means of a front shaft seal 22 between the shaft member 13 and the body 10 and a rear shaft seal 24 between the shaft member 11 and an inner stepped surface of the housing body 10**.

The lip seals 22 and 24 at opposite ends of the sealed chamber between the rotary shaft and the housing have their sealing lips directed toward the rear of the nozzle apparatus. This enables lubricating liquid to be pumped by any suitable syringe-type device into an opening sealed by the screw plug 42 for replenishment of complete replacement of the lubricating liquid in the chamber which is again sealed after such pumping. The screw plug 42 is located in an annular cap member 40 closing the front end of the housing body 10. The rear seal is oriented to allow excess lubricating liquid to escape to the area of weep ports or passages 26 in the body 10 which communicate to the outside of the housing 10 of the nozzle assembly. Complete replenishment of deteriorated and contaminated liquid is indicated by the flow of clear clean liquid from the weep ports 26 of the housing 10 as pumping of clean liquid progresses.

The forward end of the shaft structure is rotatably supported by the radial ball bearing **20*a* between the shaft extension 13 and the forward end of body 10 capped by an annular cap member 40 screwed on the outer forward end of the housing body 10. The rear end of the shaft structure 11–13 is rotatably supported by the radial ball bearing 20*b* between the shaft member 11 and the housing body 10. The axial position of the bearing 20*a* is fixed by having its outer race pushed by the end cap 40 axially into clamping engagement with the forward end of a bronze sleeve 30 abutting a shoulder projecting inwardly from the outermost cylindrical wall portion of the housing body 10. The axial position of the shaft structure 11–13 is fixed by the inner race of the bearing 20***a* being clamped between opposing shoulders on shaft member 11 and on shaft extension member 13 when these members 11 and 13 are screwed together.

It is desirable to insure that the torque produced by the discharged jets from canted nozzle tips 46 is within the operating limits of the tool. The preferred tool operational torque range is from 1.5 to 6 in.-lb. and it is generally desirable not to exceed 10 in-lb of torque. The higher figure of 10 in-lb will provide more latitude for tolerable ranges of overall operating parameters.

The jet reaction force and nozzle orientation are designed to produce from 1.5 to 6 in-lb of torque based on pump size. Too small a torque may result in erratic rotation rates or be insufficient to start rotation. Too large a torque will exceed the ability of the tool to govern rotation speed and may cause heat buildup, temperature rise in the internal parts, rapid seal wear, and excessive rotation speeds affecting the cleaning operation of the jet streams. The tool should not generally be operated at torques above 10 in-lb.

The flow rating of the tool is 0.45 Cv. This means that at 9 gpm the pressure loss through the tool is about 400 psi, while at 12 gpm the loss is about 710 psi.

The outside wall of the plastic seal 17 fits snugly against the wall of the counterbored stepped recess in the stationary seal holder 16. The O-ring seal 17' in the longitudinally-central annular groove in the seal 17 not only provides additional sealing means between the plastic seal and the wall of the stepped recess but also aides in holding the plastic seal 17 in position against rotation as the seal 17 is pushed forward by pressure of the spray liquid on the plastic seal and sealed against the carbide seat 18 as the seat 17 is held sealed against and rotates with the input end of shaft member 11. The seat 18 rotates with the shaft during operation of the nozzle. As the end of the plastic seal 17 wears where it contacts the carbide seat 18, liquid pressure on the plastic seal 17 will push it forwardly along the counterbored cylindrical recess of the seal holder 16 to assure continuity of the sealing assembly at the input end of the shaft member 11. The importance of the O-ring 17' is to keep high pressure liquid from flowing or leaking around the outside of the plastic seal 17.

Figure 7A:
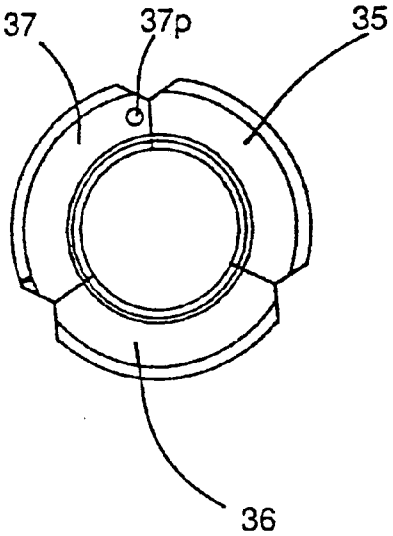
FIG. 7A is a front end view of the cluster of centrifugal weights shown in FIG. 7.

The retarding means for controlling the speed of the self-rotating nozzle shaft structure comprises two components which frictionally engage the inner cylindrical surface of the non-rotating bronze sleeve 30 clamped to the housing body 10. These components are a radially expandable helical coil spring device 34 encircling the shaft structure and a centrifugally responsive weight means in the form of a weight cluster including three elongated segment weight elements 35–37 arranged around a cylindrical body portion 11*a* of the shaft member 11. The weight cluster includes coiled garter type spring means 33 of spring steel collectively encircling the weight elements in grooves 33*a* for biasing the weights toward the rotational axis of the nozzle shaft structure and, when idle, into contact with the outer cylindrical body portion 11*a* of the shaft member 11. FIG. 7A shows these complementary shaped segment weight elements 35–37 as held together by the garter springs 33 and each weight has an inner arcuate cylindrical surface with a radius of curvature complementary to the outer diameter of the cylindrical surface portion 11*a* of the shaft member 11 which the weights engage in their idle positions. The outer arcuate surfaces of the weights each has a cylindrical radius of curvature spaced about 0.020 inches from the inner cylindrical surface of the sleeve 30 when the weights are in their idle positions and which move centrifugally to engage the sleeve 30 when the weights move to their active retarding positions. The sleeve 30 has an inner diameter cylindrical surface of about 1.20 inches and the outer diameters of the weights and of the spring in their idle configurations is 0.020 inches smaller in diameter or 0.010 inches less in radius of curvature than the sleeve's inner surface. To unwind sufficiently for all turns of the spring to contact the inner diameter of the sleeve, the forward end of the spring rotates about 60 degrees relative to the rear end of the spring.

FIGS. 4–7 show details of the interconnections between the ends of the coil spring 34 and the driving shaft member 11 and weight element 37 of driven centrifugal weight element means 35–37. The spring is a continuous cylindrical helix. A spring engaging flange 38 on the forward end of shaft member 11 has in a rim portion thereof a peripheral arcuate dead end arcuate slot 38*a* about 1/16 inch wide and about 1/4 inch long to receive and hold the forward end of the coil spring 34. The forward end of the weight element 37 has a rim portion 39 with a similar dead end arcuate slot 39*a* to receive and hold the rear end of the coil spring 34.

The coil spring has 10 turns of 0.049 in. sq. spring steel which are wound in abutment with one another when the opposite ends are held respectively in the slots 38*a* and 39*a*. Lubricating fluid can flow around and between the turns as an aid to keeping the spring cool during its retarding operation.

During assembly of the shaft member 11, the coil spring 34 and the weight elements 35–37, the weight elements are first clamped together by the garter springs 33. The spring 34 is placed over the head portion 11*b* of the shaft member 11 with the forward end of the spring engaged in the slot 38*a*. The weight cluster 35–37 is then placed over the body portion 11*a* of the shaft member and the coil spring 34 and weight 37 are relatively manipulated to engage the rear end of the spring 34 in the slot 39*a*. During this assembly an axially extending pin 37*p* fixed in the end of weight 37 is positioned over the surface of a wrench flat 11*f* to unidirectionally limit relative rotation of the weight cluster 35–37 with respect to the shaft member 11 to prevent weight 37 from moving beyond the rear tip of the spring 34. Such limited rotation between these parts provides means to prevent the ends of the spring from being withdrawn from the slots 38*a* and 39*a* during operation of the retarding apparatus. The pin 37*p* while limiting relative rotation of weight 37 and shaft member 11 in one direction will move over a cutaway portion of the flat 11*f* to allow sufficient relative movement of the pin in the opposite direction so that the shaft member can unwind the coil spring 34 sufficiently after the weights engage the inner surface of the sleeve 30 to enable the turns of the coil spring to frictionally engage the inner of the sleeve 30. The spring dimensions are such that relative unwinding movement of about 60° of the forward end of the spring relative to the rear end of the spring or about 6.0° per spring turn is sufficient to move the outer surface of the unwound spring 34 into engagement with the inner surface of the sleeve 30.

The coil spring has a tip end which is driven by slot 38*a* at the forward end of the shaft member 11. The turns of the spring are wound so as to progress clockwise like a right hand screw in the direction away from the discharge end of the nozzle. Rotation of the shaft structure forces the forward end of the coil spring to rotate via slot 38*a* in the direction of rotation such that the driving force from the shaft tends to unwind the coil spring.

Figure 7:
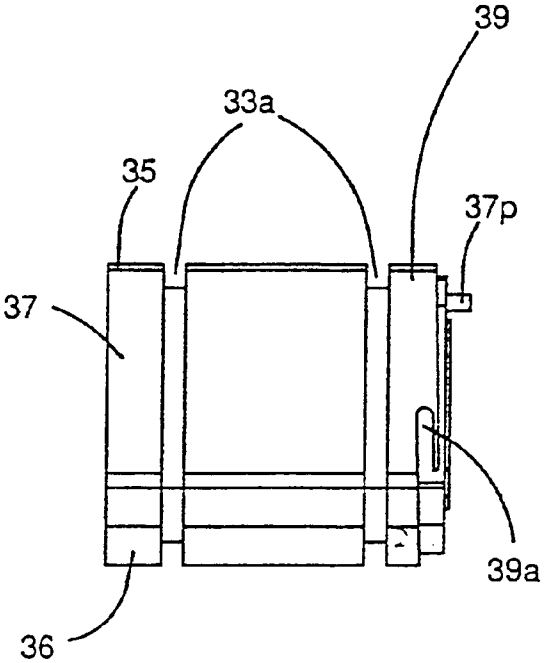
FIG. 7 is a side view of a cluster of centrifugal weights forming part of the subassembly of FIG. 4.

A rotating force applied by the slot 38*a* to the front tip of the spring is transferred through the spring turns, in a clockwise direction as mentioned, to the rear coil spring tip engaged in slot 39*a* to drive weight 37 clockwise as seen in FIG. 7. In an idle or stopped condition of the shaft structure the coil spring 34 and the weight elements 35–37 are slightly spaced from the inner cylindrical surface of the sleeve 30 and remain so until driven to a rotating speed near a range of speed in which retarding action on the shaft structure is intended to take place to keep the shaft from overspeeding. Below this control range, nozzle speed is not retarded by action of the coil spring 34. Centrifugal operation of weights 35–37 over the relatively flat and nearly linear speed curve from A to B in FIG. 8 does not cause significant unwinding of the spring 34. However, near point B the centrifugal force on each of the weights 35–37 moves them into frictional engagement with the inner cylindrical surface of the bronze sleeve 30 and initiates retarding action on the rotating shaft by unwinding of the spring into contact with the sleeve 30.

The outer surfaces of the weight elements engage the inner cylindrical surface of sleeve 30 and the friction occurring at the surfaces of weight elements 35–37 is applied via slot 39*a* on weight element 37 as a retarding force to the rear tip of the coil spring 34. This retarding force from friction on element 37 is supplemented by frictional forces from elements 35 and 36 as they are pushed ahead by weight element 37. The retarding force of the centrifugal weight cluster 35–37 not only is at least initially transferred through the turns of the coil spring via slots 39*a* and 38*a* to the shaft structure, but also the initial retarding force acts to create a further retarding force due to an unwinding of the coil spring 34 into contact with the sleeve 30.

The turns of coil spring 34 are dimensionally uniform and present an outer cylindrical surface of minimum diameter when the spring is in an idle state. However, during unwinding of the coil spring 34 by the action of centrifugal weights 35–37 the coil spring diameter progressively increases until the retarding action of the weights causes engagement of the outer surface of the spring with the inner surface of sleeve 30 whereupon an additional frictional force is directly applied by the spring to the shaft structure at the slot 38*a*. This happens at a point near B in the curve of FIG. 8 and above this speed a complicated but dramatic effect takes place as the shaft speed vs. nozzle self-driving torque curve rises exponentially until near point C an equilibrium condition is reached between: (a) the self-driving torque of the nozzle generated by its jet streams, and (b) the resistive and retarding forces within the nozzle assembly. Beyond point C the rotational shaft speed does not increase with out a significant change in the self-generated nozzle torque as might occur, for example, by a significant change in the flow rate of high pressure liquid from the nozzle jets. The closeness of the points B and C for a selected acceptable desired speed range along the speed axis of FIG. 8 gives considerable latitude in designing the retarding components within the nozzle assembly to provide a retarding action in the wide range from B to C along the vertical axis of FIG. 8 without nozzle shaft over-speeding beyond the small acceptable or desired speed range available from B to C.

At maximum speed of the shaft structure near point C the retarding friction force between the coil spring 34 and the sleeve 30 is at least several times the retarding friction force between the weight cluster 35–37 and the sleeve 30.

Figure 8:
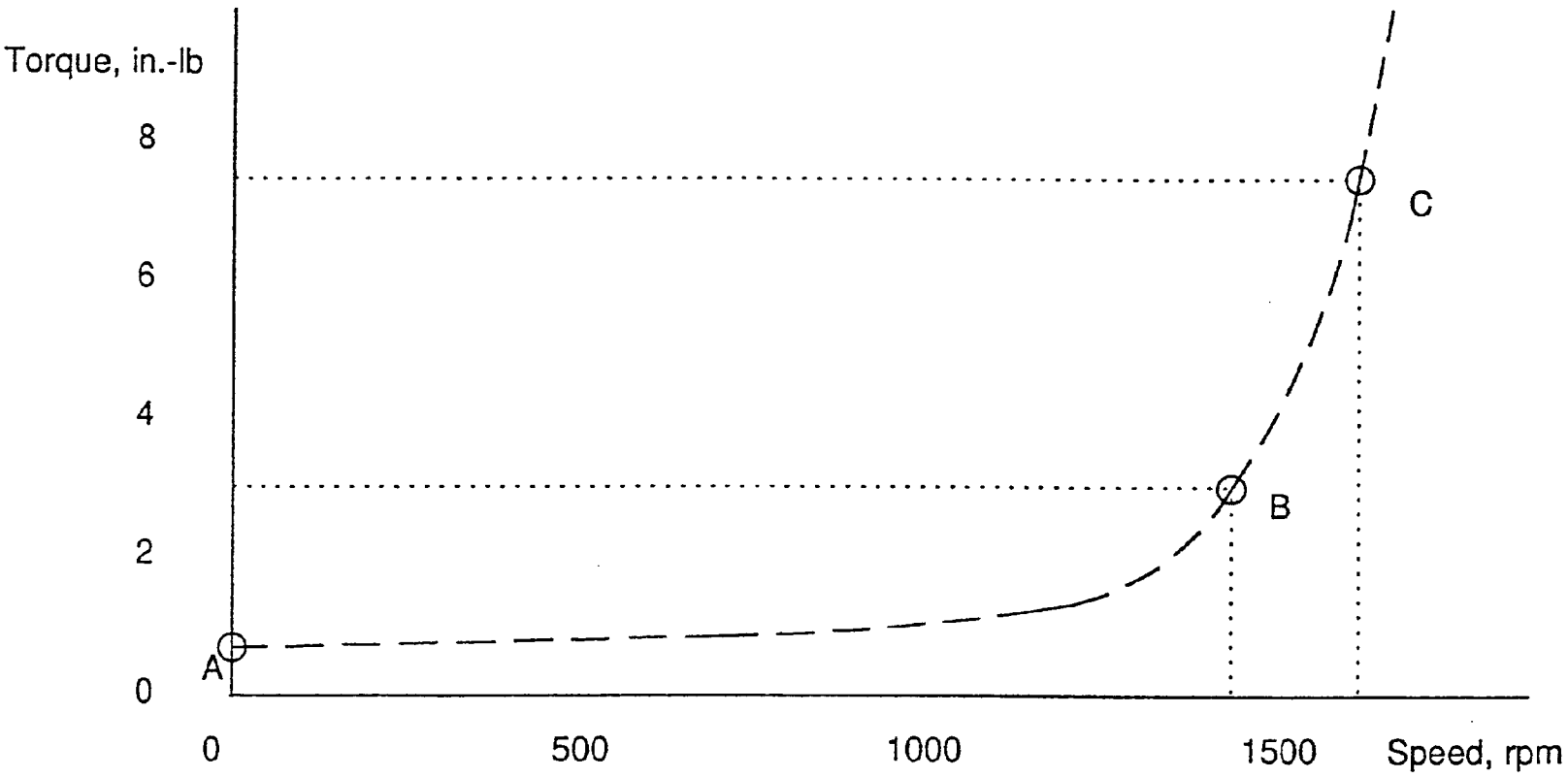
FIG. 8 is a graphical illustration of the relationship between self-generated reaction torque of the rotating nozzle versus rotating nozzle speed when using a nozzle speed retarding mechanism in accordance with the present invention.

The exponential shape of the retarding force curve from B to C of FIG. 8 in which there is controlled retarding friction between the nozzle shaft and the stationary housing produced by the coil spring is believed to be related to slippage between a belt and a pulley driven thereby as expressed by Eytelwein's equation (found in the Standard Handbook of Machine Design) which is used for analyzing belt forces and correlates the coefficient of friction and the arc of belt contact along which slippage exists.

Figure 9:
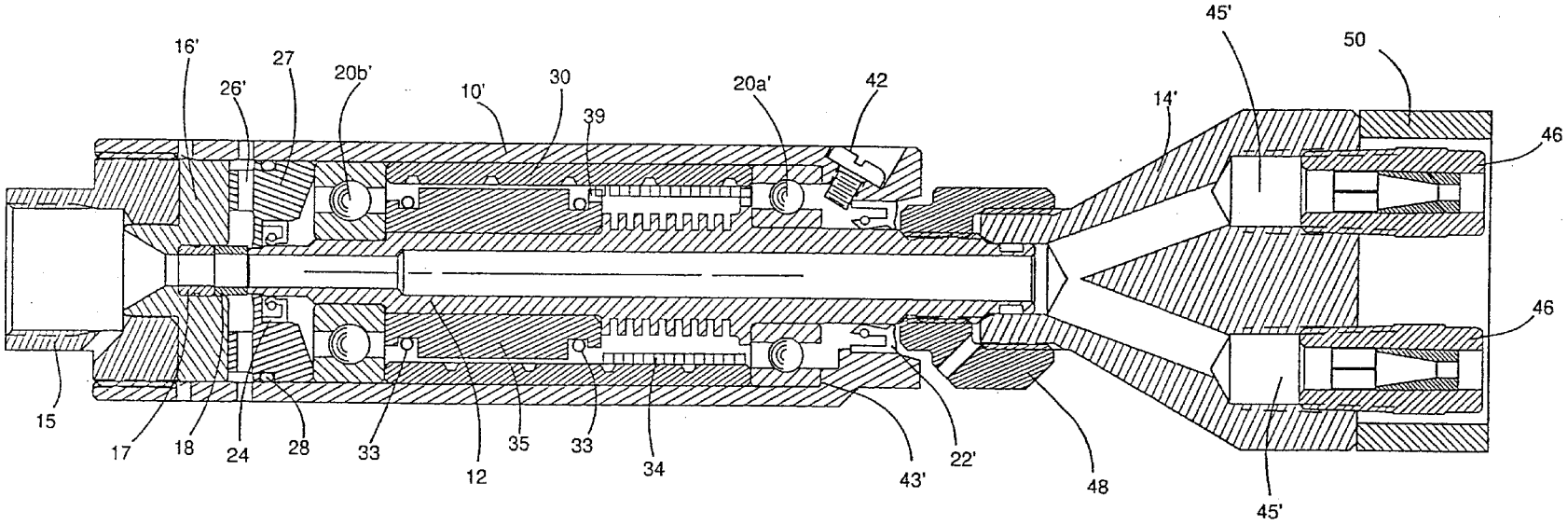
FIG. 9 is a view similar to FIG. 1 showing an alternative embodiment also using a coil spring speed control mechanism.

The coil spring 34, after being expanded by unwinding to engage the bronze sleeve 30, adds much shaft retarding frictional resistance at the sleeve and heat generation within the bearing and speed control chamber is highest along the spring. As seen in FIGS. 1 and 9 the coil spring 34 is located at a longitudinally central position along the shaft structure 11–13 (FIG. 1) or the shaft 12 (FIG. 9) to obtain optimum heat transfer from the area of the coil spring to the central area of the shaft structure and therealong towards opposite ends of the shaft structure to maximize heat transfer to the high pressure liquid flowing through the shaft structure. A suitable lubricating liquid for the bearings, weights and coil spring is conventional automatic transmission fluid which is injected into the sealed chamber through an opening in the cap 40 which opening is normally sealed to confine the lubricating liquid in the chamber by the screw plug 42. The lubricating liquid for the bearings and the braking surfaces is agitated and continually stirred or churned within the sealed chamber. Heat is extracted from the rotating weights, coil spring and bearings directly by conduction to other engaged parts of the nozzle apparatus and indirectly by heat transfer via the lubricating liquid to other parts of the nozzle apparatus including the bronze sleeve and the outer surface of the tubular nozzle structure through which the high pressure spraying fluid is being forced during spraying operations.

Conventional automatic transmission fluid (ATF) has a viscosity of about 7.24 centistokes at 100° C. and 33.3 centistokes at 40° C., a temperature limit of about 240° F., and a viscosity index exceeding 190. ATF has a high shear stability as compared to conventional motor oils. For synthetic ATF blends the respective viscosities (7.5 and 34 centistokes), temperature limit 270° F. and viscosity index (198) are somewhat higher. For a synthetic ATF the temperature limit may be still higher or about 300° F. It is desirable that the viscosity of the lubricating liquid used with this invention remain stable during continuous use of the nozzle apparatus.

FIG. 9 shows another embodiment of the invention described in greater detail below, but uses several common parts with like reference numbers as in as in FIG. 1 with same functions in the retarding mechanism including: bronze sleeve 30, centrifugal weights 35–37 (36 not appearing in the section of FIG. 9), garter springs 33 and the coil spring 34. Several other like parts from FIG. 1 bear like reference numbers in FIG. 9. Some parts similar to those of FIG. 1 and having like function in FIG. 9 have a prime notation added to the reference number.

FIG. 9 shows a high pressure liquid nozzle apparatus assembly having an elongated cylindrical nozzle housing body 10' within which is rotatably mounted a coaxial hollow shaft 12 which carries high pressure liquid to a discharge spray head 14' at one end of the body 10'. The nozzle means on the forward end of the rotating shaft provides multiple jet streams of the liquid for cleaning purposes with the streams oriented to provide a jet reaction torque on the shaft to make it self-rotating in a clockwise direction as seen from the discharge end of the nozzle.

As seen in FIG. 9, the arms of the Y-shaped passage in the head 14' of the rotatable shaft structure connect with threaded cylindrical canted bores 45' in the forward end of the head 14'. Nozzle discharge tips 46 are threaded into these canted bores. The end of the upper nozzle tip 46 in FIG. 9 is canted toward the reader and the end of the lower nozzle tip 46 in FIG. 9 is canted away from the reader so that reaction forces due to jet streams from the nozzle tips 46 rotate the nozzle head 14' clockwise as seen looking toward the nozzle discharge end, or in the direction of a right hand screw to keep the head 14' screwed onto the shaft member 12 via a right hand threaded male to male adapter 48.

High pressure liquid is supplied to the inlet end of the shaft 12 by inlet means comprising an inlet nut 15 which is internally threaded to connect to a source of high pressure liquid (not shown). Along the inside cylindrical surface of the housing body 10' the inlet nut 15 clamps a stack of coaxial parts together tightly in place end-to-end and against an inwardly directed shoulder of the housing body 10' near its forward or outlet end. This stack of parts in order consists of a seal holder 16', seal retainer 27 for lip seal 24, the outer bearing race of ball bearing **20*b*', the bronze sleeve 30, and the outer bearing race of ball bearing 20*a*' which abuts the housing body shoulder 43'**.

In FIG. 9 a lip seal 22' at the forward end of the body 10' and a lip seal 24 against the shaft 12 in the seal retainer 27, and an O-ring 28 sealing the outer periphery of the retainer 27 to body 10', define the ends of a sealed chamber between housing body 10' and shaft 12 for isolating the shaft bearings, the shaft retarding mechanism and the lubricating liquid from the high pressure liquid passages in the nozzle assembly. The lubricating liquid is injected into the sealed chamber through an opening in the forward end of the body 10' which opening is normally sealed to confine the lubricating liquid in the chamber by the screw plug 42. Any high pressure liquid leaking to the outside of the seal 17 and seat 18 can escape to holes through the wall of the housing body 10' by means of radial weep holes **26*a* in the retainer 27. Like the shaft 11 of FIG. 1, the inlet end of the shaft 12 has a reduced diameter portion extending rearwardly through a small aperture in a transverse wall in the retainer 27 for lip seal 24 and into the chamber bled by weep holes 26*a* where the seat 18 seals against the inlet end of the shaft 12**.

The seal holder 16' has a stepped coaxial passage presenting a smooth inner cylindrical surface within which are coaxially supported in end-to-end relationship an annular cylindrical deformable seal member 17 and an annular cylindrical rigid seal seat 18 which is held solely by high liquid pressure on the seal member 17 and on the seat to force the seat against the inlet end of the shaft 12. The sealing seat member 18 has a first end face beveled at its outer edge and abutting the shaft with an area of contact smaller than an area where its opposite end face abuts the seal member 17 whereby the pressure differential across the seat 18 due to the high pressure liquid in said inlet passage maintains a net force holding the seat 18 against the shaft during operation of the apparatus.

The shaft portion 12 and the removable spray head 14' with the Y-shaped liquid passage forms two main parts of a multi-piece rotary shaft structure. The rear male end of head 14' is screwed onto the forward threaded male end of the shaft portion 12 by means of the male to male adapter 48.

A round thick disk-shaped nozzle tip protector 50, used in both FIGS. 1 and 9, has bores therethrough aligned with and protectively enclosing the removable nozzle tips 46. The protector 50 has a base portion fastened to the end face of the head 14 or 14' by screws (not shown). Threaded holes 47 for those screws appear in the end face of head 14 in FIGS. 2–3 in circumferentially spaced areas between the threaded bores 45 for nozzle tips 46. The disk-shaped protector 50 allows this end of the nozzle assembly to rotate without the nozzle tips 46 striking and being damaged by engagement with surfaces being cleaned.

A comparison of FIGS. 1 and 9 shows the space or size saving achieved in FIG. 1 by screwing the shaft member 13, carrying the nozzle tips 46 in the head 14, into the enlarged female threaded end of shaft member 11 at the concealed and inaccessible location within the coil spring 34. The outer housings 10 and 10' and the heads 14 and 14' have respective like outside diameters. The bronze sleeves, the weights and the coil springs are of identical sizes.

The bronze sleeve 30 is made of ASTM 660 bronze. The spring 34 is made of heat treated spring steel. The weights 35–37 are made of type 303 stainless steel. The material of these rubbing parts and the lubricant should be chosen to minimize galling at the rubbing surfaces during operation of the retarding apparatus.

It is believed that the basic principal of operation of the retarding mechanism of this invention includes two related energy dissipating mechanisms in which a first mechanism rotating with the nozzle senses relative motion between the rotating nozzle and its relatively stationary housing and creates a retarding action on this first mechanism to slow its rotation relative to the housing. This slowing is achieved by the centrifugal weight cluster moving progressively closer to the housing after a minimum designed speed is attained. After this minimum designed speed is attained the centrifugal forces on the weights cause them to start moving outwardly as these forces exceed the retaining force of the garter springs around the weight cluster. At lower nozzle speeds the garter springs keep the weights in their non-actuating position against the nozzle shaft.

The lubricating liquid filling the sealed chamber containing the nozzle shaft bearing is subject to some viscous shear and turbulence but the nozzle shaft speed is permitted to accelerate with only a relatively small resistance to the self-generated nozzle torque as the nozzle speed increases from an initial stopped condition at point A on the curve of FIG. 8 and quickly reaches a speed at point B near the lower end of a desired operating speed range.

Near point B the weights move outwardly and as they get progressively closer to the bronze sleeve significant viscous shear occurs in the lubricating liquid by the relative movement of the weights with respect to the bronze sleeve and the energy dissipated by this viscous shearing action creates a drag on the weights as they closely approach the bronze sleeve. Although the steel weights and the bronze sleeve are selected as relatively anti-galling materials in case they rub against one another at least a film of lubricating liquid is preferably kept between the weights and the bronze sleeve.

The second and principal energy dissipating mechanism of the two aforementioned related energy dissipating mechanisms is coupled to the first mechanism by means providing what is akin to a mechanical advantage generating function for causing a portion of the second mechanism which rotates with the nozzle shaft to interact with the bronze sleeve and dissipate energy at a rate which increases exponentially as a function of further nozzle speed increase. This second energy dissipating mechanism is the coil spring immersed in lubricating liquid and progressively unwound by the action of the weights retarding the rear end of the spring whereby there is an increase in shaft speed retardation force in moving from point B to point C of the FIG. 8 curve. Thus, maximum retarding force limiting nozzle speed is achieved when the retarding forces on the nozzle shaft are in equilibrium with the torque applied to the nozzle shaft by the reaction from jets streams issuing from the nozzle discharge tips.

Although there is some energy dissipation at the weights as they are subject to slightly increasing resistance forces relative to the bronze sleeve as the shaft speed moves from point A to point B, the total force causing retardation of the nozzle shaft is not greatly increased until the weights apply a retarding force to the rear end of the spring. As the outer surface of the spring windings expand on unwinding and are pressed toward the bronze sleeve a great increase in viscous shear in the lubricating liquid between the spring and the coil windings occurs converting shaft rotational energy into heat energy in the second retarding or energy dissipating mechanism.

It is recognized the heat generated at the coil spring is a maximum at its front end and decreases progressively from the front end to the end engaged by the weight cluster.

It is preferred for optimum tool life with low cost tool materials that a film or layer of the lubricating liquid in which the weight cluster and the coil spring are immersed remains between these immersed parts and the bronze sleeve to avoid a dry friction condition at the proximate surfaces of these parts to provide a significant amount of retardation by viscous shear in the lubricating liquid and to prevent inordinate wear of the relatively moving parts. In cases where continuous operation is desirable this lubricating film is important. However, where short duration or intermittent operation is acceptable, or when environmental conditions dictate, dry friction conditions may be tolerated.

Except where otherwise described, reference in this specification to engagement or frictional engagement between the weights or the coil spring and the bronze sleeve is intended to include either dry engagement or wet engagement where the surfaces are wetted by the lubricating liquid.

Except as otherwise described, all metallic components of the assemblies of the preferred embodiment herein are preferably made from a strong non-corrosive material such as stainless steel.

Other variations within the scope of this invention will be apparent from the described embodiments and it is intended that the present descriptions be illustrative of the inventive features encompassed by the appended claims.

What is claimed is:

1. A rotary retarding device for connection between a reference structure and a rotary structure to control the speed of rotation of the rotary structure relative to the reference structure, said device comprising a friction surface means connected to said reference structure and providing an internal cylindrical surface coaxial with an axis of rotation of said rotary structure, centrifugally responsive weight means carried by and rotatable with said rotary structure, said weight means having external surface portions engageable with said internal cylindrical surface upon centrifugal outward displacement of said weight means with respect to said axis, spring biasing means for biasing said weight means toward said axis and away from said internal cylindrical surface, driving means for rotating said rotary structure in one direction about said axis, a helically wound coil spring coaxially encircling a portion of said rotary structure and having one end in driven engagement with a portion of said rotary structure which tends to unwind and increase the diameter of the coil spring when said one end of the coil spring is driven by the rotary structure in said one direction, means for coupling a second end of said coil spring to said weight means whereby the coil spring rotates said weight means in said one direction about said axis in response to rotation of the rotary structure in said one direction, said weight means being centrifugally responsive to increased rotational speed of said rotary structure in said one direction to frictionally engage said internal cylindrical surface and retard movement of said second end of the coil spring in said one direction and increasingly unwind the coil spring so that its turns increase in diameter and frictionally engage said internal cylindrical surface to retard relative rotational movement of said rotary structure with respect to said reference structure.

2. A rotary retarding device according to claim 1 wherein said reference structure is a non-rotating structure.

3. A rotary retarding device according to claim 1 wherein said weight means and said coil spring do not engage said internal cylindrical surface when the rotary structure is not rotating.

4. A rotary retarding device according to claim 1 wherein said weight means comprises a plurality of weight elements arranged around the rotary structure and including garter type spring means collectively encircling the weight elements for biasing the weights toward said axis.

5. A rotary retarding device according to claim 1 wherein said rotary structure is a spray nozzle.

6. A rotary retarding device according to claim 5 wherein said driving means for rotating said rotary structure includes jet stream nozzle means creating a reactive force driving said rotary structure in said one direction in response to spraying jet streams from the nozzle means.

7. A rotary retarding device according to claim 5 wherein said spray nozzle comprises a rotatable tubular structure having an outlet spraying end and an inlet end within said reference structure and including means for supplying a high pressure spray liquid to said inlet end.

8. A rotary retarding device according to claim 1 including means for confining a high temperature resistant liquid of stable viscosity as a lubricating medium between said internal cylindrical surface and said weight means and said coil spring.

9. A rotary retarding device according to claim 1 including means for confining automatic transmission fluid as a lubricating medium between said internal cylindrical surface and said weight means and said coil spring.

10. A rotary retarding device according to claim 1 wherein said internal cylindrical surface is part of a removable cylindrical sleeve secured in said reference structure.

11. A rotary retarding device according to claim 1 wherein said internal cylindrical surface is part of a removable cylindrical bronze sleeve secured in said reference structure.

12. A nozzle assembly for spraying high pressure liquid against an object and comprising:

a hollow cylindrical housing body having an inner cylindrical surface, a tubular shaft structure rotatable coaxially within the housing body and having a liquid input end, said shaft structure having an output end and including means at said output end providing a spray nozzle head for rotation with the shaft structure, axially spaced bearing means between said shaft and said inner cylindrical surface of the housing body to rotatably support said shaft structure coaxially within the housing body and to prevent axial movement of the shaft structure when the shaft structure is subject to high axial forces during spraying, means defining a sealed chamber between said housing body and said shaft structure for enclosing said bearing means and a high temperature resistant lubricant therefor, input means for connecting a high pressure liquid source to an input end of said nozzle assembly in sealed relationship with the input end of the shaft structure, retarding means in said sealed chamber and coupled to said shaft structure for applying a retarding force to the shaft structure to prevent its rotational speed from exceeding a desired range, said high pressure liquid input means including a cylindrical bore coaxial with said shaft structure with said bore having at its inner end an annular inwardly extending shoulder facing away from said shaft structure, said input means including a sealing assembly forming a high pressure liquid sealed passage between the high pressure liquid source and the liquid input end of said shaft structure, said sealing assembly including an annular seal holder and first and second coaxial seal members carried end to end by the seal holder, said seal members having differential areas being forced axially toward the liquid input end of the shaft structure by said high pressure liquid acting over said differential areas of the seal members, said seal holder having an outer coaxial cylindrical surface slidable in said bore and having opposite end faces extending inwardly from its outer cylindrical surface, one end face of said seal holder abutting said inwardly extending shoulder at the inner end of said bore, and means defining an internally threaded coaxial connection at the outer end of the bore for receiving a threaded coupling on a high pressure liquid conduit whereby the threaded coupling will engage the other end face of the seal holder to hold said one end face and said shoulder in tight sealing abutment, said sealing assembly being removable axially from the input end of the nozzle assembly upon removal from the nozzle assembly of the threaded coupling on the high pressure liquid conduit without disturbing the sealed integrity of the sealed chamber and without removing other parts of the nozzle assembly.

13. A nozzle assembly according to claim 12 wherein the means for defining the cylindrical bore in the liquid inlet passage is part of the housing body.

14. A nozzle assembly according to claim 12 including an annular end cap on a second end of the nozzle assembly, said end cap being screwed on the housing body and having a central opening in sealed relationship with the surface of the shaft structure to close the sealed chamber at said second end of the nozzle assembly.

15. A nozzle assembly according to claim 12 wherein the retarding means in said sealed chamber includes a radially expandable coil spring means actuated in response to centrifugal forces of weight means coupled to the shaft to create retarding forces applied to the shaft structure for retarding its rotational speed when the speed exceeds a desired range.

16. A nozzle assembly according to claim 15 wherein said chamber includes a cylindrical sleeve having an inner surface frictionally engageable by said coil spring and said weight means to create a rotary retarding force applied to the shaft structure.

17. A nozzle assembly according to claim 16 wherein at maximum rotary speed of the shaft structure the retarding friction force between the coil spring and the sleeve is at least several times the retarding friction force between the weight means and the sleeve.

18. A nozzle assembly according to claim 13 wherein the shaft structure includes a removable nozzle carrying extension member having a tubular supporting portion extending within the housing body to a concealed point of threaded attachment in the shaft structure.

19. An elongated slender nozzle assembly for spraying high pressure liquid against an object and comprising:

a hollow cylindrical housing body having an elongated inner cylindrical surface, a tubular shaft rotatable coaxially within the housing body and having a liquid input end within and near one end of said housing body, said shaft having an output end near a second end of the housing body and including means at said output end for securing a spray nozzle for rotation with the shaft, axially spaced bearing means between said shaft and said housing body to rotatably support said shaft coaxially within the housing body and to prevent axial movement of the shaft when the shaft is subject to high axial forces during spraying, means defining a sealed chamber enclosing said bearing means and a high temperature resistant lubricant therefor between said housing body and said shaft, input means for connecting a high pressure liquid source to said nozzle assembly in sealed relationship with the input end of the shaft, driving means for rotating said shaft in one direction about said axis, a helically wound coil spring coaxially encircling a portion of said shaft and having one end in driven engagement with a portion of said shaft which tends to unwind and increase the diameter of the coil spring when said one end of the coil spring is driven by the rotary structure in said one direction, means for coupling a second end of said coil spring to centrifugal weight means whereby the coil spring rotates said weight means in said one direction about said axis in response to rotation of the shaft in said one direction, said weight means being centrifugally responsive to increased rotational shaft speed in said one direction to frictionally engage an internal cylindrical surface in the housing body and retard movement of said second end of the coil spring in said one direction and increasingly unwind the coil spring so that its turns increase in diameter and frictionally engage said internal cylindrical surface to retard relative rotational movement of said shaft with respect to the housing body to limit shaft speed to a desired range.

20. A nozzle assembly according to claim 19 wherein the centrifugal weight means comprises several elongated weight segments having outer curved surfaces engageable with the internal cylindrical surface in the housing body.

21. A nozzle assembly according to claim 20 wherein the elongated weight segments are collectively encircled at their opposite ends by springs to spring bias the weights toward the axis of rotation of the shaft structure.

22. A nozzle assembly according to claim 19 wherein both the weight means and the coil spring produce a shaft retarding drag when engaged with the internal cylindrical surface in the housing body, but the shaft retarding drag imposed by the coil spring is at least several times greater than the drag produced by the weight means when the shaft rotates at a desired speed.

23. A nozzle assembly according to claim 21 wherein the combined lengths of the coil spring and the weight means is about forty percent of the length of the housing body.

24. A nozzle assembly according to claim 19 wherein the coil spring is near the longitudinal center of the shaft to aid in dissipating heat along the shaft and therefrom to the liquid passing through the shaft.

25. A coupling apparatus for controlling the relative rotational speed between a rotatable first member and a second member comprising:

means for applying torque to said rotatable first member in a range between a first lower torque value and a second higher torque value to cause the speed of rotation of said rotatable first member relative to said second member to increase, coupling means rotatably driven by said rotatable first member and responsive to increasing rotational speed of said rotatable first member for applying an increasing frictional force to said second member to retard the rotational speed of said first member relative to said second member, said coupling means including a centrifugal weight means for initially engaging said second member as the rotational speed of said first member increases to a first speed and a coil spring connected between said first member and said centrifugal weight means and arranged to be unwound by relative rotation of said first member with respect to said weight means to frictionally engage said second member upon unwinding whereby at a speed above said first speed a retarding force of the coil spring on said first member becomes substantially greater than the retarding force of the weight means on the first member, said coupling means limiting the maximum rotational speed of the first member relative to the second member to a speed at which the retarding force of the coupling means and the torque applied by said means for applying torque to the first member are in equilibrium.

26. A rotational speed control apparatus comprising:

a driven rotatable member whose speed is to be kept within a desired rotational speed range with a practical maximum speed, a relatively stationary member supporting said driven member, driving means for providing a selected amount of torque for driving said driven member relative to said relatively stationary member, a first energy dissipating mechanism for sensing the rotational speed of the driven member relative to said relatively stationary member, a second and primary energy dissipating mechanism interacting between the two driven and relatively stationary members, and coupling means between said first and second energy dissipating mechanisms whereby when said first mechanism senses a rotational speed near the lower end of said desired speed range it actuates the second energy dissipating mechanism to impose a retarding force on the driven member and limit maximum driven member rotational speed to said practical speed at which retarding forces of the two mechanisms on the driven member are in equilibrium with and opposed to the driving torque of said driving means on said driven member.

27. A rotational speed control apparatus according to claim 26 including means defining a sealed chamber containing a high temperature resistant lubricating liquid in which said mechanisms are immersed.

28. A rotational speed control apparatus according to claim 26 wherein said first mechanism is a centrifugally responsive mechanism.

29. A rotational speed control apparatus according to claim 26 wherein said second mechanism includes a coil spring radially expandable for frictional engagement with an inner cylindrical surface in said relatively stationary member, said coil spring being expandable by unwinding in response to actuation of said second mechanism to engage said inner cylindrical surface for retarding the rotational speed of said rotatable member.

* * * * *